United States Patent [19]

Kameoka et al.

[11] Patent Number: 4,725,532

[45] Date of Patent: Feb. 16, 1988

[54] SILVER HALIDE PHOTOGRAPHIC LIGHT-SENSITIVE MATERIAL AND HIGH CONTRAST NEGATIVE IMAGE FORMING PROCESS USING THEM

[75] Inventors: Kimitaka Kameoka; Junji Miyata; Masaki Okazaki; Senzo Sasaoka, all of Kanagawa, Japan

[73] Assignee: Fuji Photo Film Co., Ltd., Kanagawa, Japan

[21] Appl. No.: 824,038

[22] Filed: Jan. 30, 1986

[51] Int. Cl.[4] ..... G03C 1/02

[52] U.S. Cl. ..... 430/566; 430/581; 430/592

[58] Field of Search ..... 430/566, 581, 592, 564, 430/589

[56] References Cited

U.S. PATENT DOCUMENTS 3,932,189 1/1976 Kaneda et al. ..... 430/618
4,268,621 5/1981 Ogi et al. ..... 430/564
4,493,888 1/1985 Endo et al. ..... 430/566
4,571,380 2/1986 Noguchi et al. ..... 430/589

*Primary Examiner*—John L. Goodrow
*Attorney, Agent, or Firm*—Sughrue, Mion, Zinn, Macpeak & Seas

[57] ABSTRACT

A silver halide photographic light-sensitive material and high contrast negative image forming process using them are disclosed. The material comprises a support having thereon at least one silver halide emulsion layer in which said silver halide emulsion layer or other hydrophilic colloid layer contains at least one hydrazine derivative, at least one cationic dye selected from a cyanine dye, a hemicyanine dye and a rhodacyanine dye, and L-ascorbic acid, and has photographic characteristics of giving very high contrast of over 10 in $\gamma$, giving high practical Dmax and sensitivity, and causing less black peppers using a stable developer and having optimum spectral sensitivity for spectral energy distributions of various light sources.

8 Claims, No Drawings

SILVER HALIDE PHOTOGRAPHIC LIGHT-SENSITIVE MATERIAL AND HIGH CONTRAST NEGATIVE IMAGE FORMING PROCESS USING THEM

FIELD OF THE INVENTION

This invention relates to a silver halide photographic light-sensitive material and a process of forming a high-contrast image using the light-sensitive material. More particularly, the invention relates to a silver halide photographic light-sensitive material for use in photographic printing plate making and also a process of forming high-contrast negative image using the same.

BACKGROUND OF THE INVENTION

In the field of graphic arts, an image-forming system giving high-contrast (in particular, higher than 10 in gamma) photographic characteristics are required for obtaining good reproduction of continuous tone images by dot images or good reproduction of line images.

Hitherto, for obtaining the aforesaid purposes, a specific developer called as "lithographic developer" has been used. The lithographic developer contains hydroquinone only as the developing agent and in the developer, a sulfite as preservatives is used as an adduct with formaldehyde and the concentration of free sulfite ion is very low (usually lower than 0.1 mole/liter) so that it does not hinder the infection developability. Thus, the lithographic developer is very liable to be air-oxidized and thus has a serious disadvantage that the developer cannot endure the storage thereof over 3 days.

As a process of using a stable developer capable of giving high-contrast photographic characteristics, there are processes of using hydrazine derivatives described in U.S. Pat. Nos. 4,224,401, 4,168,977, 4,166,742, 4,311,781, 4,272,606, 4,211,857, 4,243,739, etc. According to these processes, high-contrast and high-sensitive photographic characteristics are obtained and further since it is allowed to add a sulfite ion in a high concentration to the developer, the stability of the developer to air oxidation is greatly improved as compared with conventional lithographic developers.

On the other hand, for the light exposure of photographic light-sensitive materials, various light sources (e.g., light emitting diode (LED), He-Ne laser, Ar laser, etc.,) have been developed and realized. For giving the optimum spectral sensitivity to the spectral energy distribution of these light sources, it is necessary to select spectral sensitizing dye(s) and a system using a lithographic developer has hitherto been employed. That is, in the above-described image-forming system obtaining high-contrast photographic characteristics using a stable developer and a hydrazine derivative, the increase of sensitivity and contrast is accelerated and practical Dmax (below described) is realized by the use of a cationic compound as known up to the present (e.g., Japanese Patent Application Nos. 24,891/83, 9347/85, etc.,).

In this case, by using cationic dyes in the spectral sensitizing dyes, a higher practical Dmax is realized than the cases of using anionic dyes and betaine dyes.

However, in the above-described case, an undesirable phenomenon of the increase of so-called balck pepper, etc., simultaneously occurs, which becomes a serious problem in a photographic printing plate making.

Accordingly, various efforts have been paid for preventing the occurence of black peppers while keeping the high practical Dmax using cationic dyes as spectral sensitizing dyes.

Hitherto, as a means for preventing the occurence of black peppers, it has been proposed to reduce the amount of a hydrazine derivative but the means simultaneously causes the hindrance of the increase of sensitivity and contrast and is frequently accompanied by the reduction in gamma ($\gamma$) and practical Dmax.

Therefore, a system capable of preventing the occurence of black peppers while keeping high practical Dmax and high sensitivity by the use of cationic dyes.

SUMMARY OF THE INVENTION

An object of this invention is to provide a silver halide photographic light-sensitive material having photographic characteristics of giving very high contrast of over 10 in $\gamma$, giving high practical Dmax and sensitivity, and causing less black peppers using a stable developer and having optimum spectral sensitivity for spectral energy distributions of various light sources.

Other object of this invention is to provide an image-forming process using the above-described photographic light-sensitive material.

It has now been discovered that the above-described objects can be attained by the present invention as set forth below.

That is, according to one embodiment of this invention, there is provided a silver halide photographic light-sensitive material comprising a support having at least one silver halide emulsion layer in which said silver halide emulsion layer or other hydrophilic colloid layer contains at least one hydrazine derivative; at least one cationic dye selected from cyanine, hemicyanine, and rhodacyanine; and L-ascorbic acid.

According to another embodiment of this invention, there is provided a process of forming a very high contrast negative image which comprises processing the silver halide photographic light-sensitive material described above with a developer having pH of 10.5 to 12.3 and containing a sulfite ion of at least 0.15 mole/-liter after image-exposing the light-sensitive material.

DESCRIPTION OF THE PREFERRED EMBODIMENT

The invention is explained below in detail.

As the hydrazine derivatives for use in this invention, the compound represented by general formula (I) is preferably used.

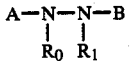

$$A-\underset{R_0}{N}-\underset{R_1}{N}-B \qquad (1)$$

wherein, A represents an aliphatic group or an aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, or a heterocyclic group; and $R_0$ and $R_1$ both represent a hydrogen atom or one of them represents a hydrogen atom and the other represents a substituted or unsubstituted alkylsulfonyl group, a substituted or unsubstituted arylsulfonyl group, or a substituted or unsubstituted acyl group.

In the above formula, however, B, $R_1$ and the nitrogen atom to which they are bonded may form a partial structure of hydrazone (—N=C<).

In general formula (I), examples of the aliphatic group shown by A are those having preferably 1 to 30 carbon atoms, in particular straight chain, branched or cyclic alkyl groups having 1 to 20 carbon atoms. In this case, the branched alkyl group may be cyclized so that a saturated heterocyclic ring containing a hetero atom is formed. Also, the alkyl group may have a substituent such as an aryl group, an alkoxy group, a sulfoxy group, a sulfonamido group, a carbonamido group, etc.

Examples of the aliphatic group include a t-butyl group, a n-octyl group, a t-octyl group, a cyclohexyl group, a pyrrolidyl group, an imidazolyl group, a tetrahydrofuryl group, a morpholino group, etc.

The aromatic group shown by A in General formula (I) shown above is a monocyclic or di-cyclic aryl group or unsaturated heterocyclic group. In this case, the unsaturated heterocyclic ring group may form a heteroaryl group by condensing with the monocyclic or dicyclic aryl group.

Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc.

The particularly preferred example of A is an aryl group.

The aryl group of unsaturated heterocyclic group shown by A may have a substituent.

Specific examples of the aforesaid substituent include a straight chain, branched or cyclic alkyl group (preferably having 1 to 20 carbon atoms), an aralkyl group (preferably monocyclic or dicyclic ring having 1 to 3 carbon atoms in the alkyl moiety), an alkoxy group (preferably 1 to 20 carbon atoms), a substituted amino group (preferably, an amino group substituted by an alkyl group having 1 to 20 carbon atoms), an acylamino group (preferably, having 2 to 30 carbon atoms), a sulfoamido group (preferably, having 1 to 30 carbon atoms), or a ureido group (preferably having 1 to 30 carbon atoms).

The group shown by A in aforesaid general formula (I) may be a group containing a ballast group which is usually used in an immobile photographic additives such as couplers, etc. The ballast group is a relatively inactive group for the photographic property having at least 8 carbon atoms. Examples of the ballast group may be selected from an alkyl group, an alkoxy group, a phenyl group, an alkylphenyl group, a phenoxy group, an alkylphenoxy group, etc.

A in general formula (I) may contain therein a group capable of strengthening the absorption for the surfaces of silver halide grains. Examples of such adsorptive groups include a thiourea group, a heterocyclic thioamido group, a mercapto heterocyclic group, a triazole group, etc., as described in U.S. Pat. Nos. 4,385,108, 4,459,347, Japanese Patent Application (OPI) Nos. 195,133/84, 200,231/84, 201,045/84, 201,046/84, 201,047/84, 201,049/84, 36,788/84, 11,459/85, 19,739/85, etc.

B in general formula (I) above practically represents a formyl group, an acyl group (e.g., an acetyl group, a propionyl group, a trifluoroacetyl group, a chloroacetyl group, a benzoyl group, a 4-chlorobenzoyl group, a pyruvoyl group, a methoxalyl group, a methyloxamcyl group, etc.,), an alkylsulfonyl group (e.g., a methanesulfonyl group, a 2-chloroethanesulfonyl group, etc.,), an arylsulfonyl group (e.g., a benzenesulfonyl group, etc.,), an alkylsulfinyl group (e.g., a methanesulfinyl group, etc.,), an arylsulfinyl group (e.g., a benzenesulfinyl group, etc.,), a carbamoyl group (e.g., a methylcarbamoyl group, a phenylcarbamoyl group, etc.,), a sulfamoyl group (e.g., a dimethylsulfamoyl group, etc.,), an alkoxycarbonyl group (e.g., a methoxycarbonyl group, a methoxyethoxycarbonyl group, etc.,), an aryloxycarbonyl group (e.g., a phenoxycarbonyl group, etc.,), a sulfinamoyl group (e.g., a methylsulfinamoyl group, etc.,), an alkoxysulfonyl group (e.g., a methoxysulfonyl group, an ethoxysulfonyl group, etc.,), a thioacyl group (e.g., a methylthiocarbonyl group, etc.,), a thiocarbamoyl group (e.g., a methylthiocarbamoyl group, etc.,), or a heterocyclic group (e.g., a pyridine ring, etc.,).

Particularly preferred groups shown by B are a formyl group and an acyl group.

Also, B in general formula (1) may form a partial structure of hydrazone,

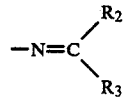

together with $R_1$ and the nitrogen atom to which they are bonded.

In the above formula, $R_2$ represents an alkyl group, an aryl group or a heterocyclic group and $R_3$ represents a hydrogen atom, an alkyl group, an aryl group, or a heterocyclic group.

Also, $R_0$ and $R_1$ each represents a hydrogen atom, an alkylsulfonyl group having at most 20 carbon atoms, an arylsulfonyl group having at most 20 carbon atoms (preferably, a phenylsulfonyl group or a phenylsulfonyl group substituted so that the sum of Hammett's substituent group constants is at least −0.5) or an acyl group having at most 20 carbon atoms [preferably, a benzoyl group, a benzoyl group substituted so that the sum of Hammett's substituent group constants is at least −0.5, or a straight chain, branched or cyclic unsubstituted or substituted aliphatic acyl group (examples of the substituent are a halogen atom, an ether group, a sulfonamido group, a carbonamido group, a hydroxy group, a carboxy group, and a sulfonic acid group)].

In this case, $R_0$ and $R_1$ are most preferably hydrogen atom.

Then, specific examples of the hydrazine derivatives for use in this invention are shown below but the invention is not limited to these compounds.

I-1

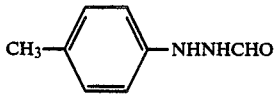

I-2

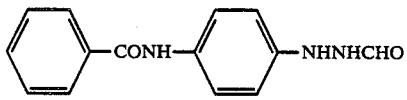

-continued
I-3
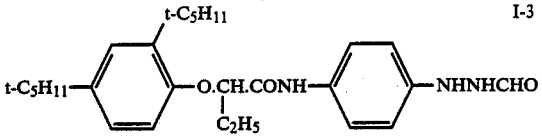
I-4
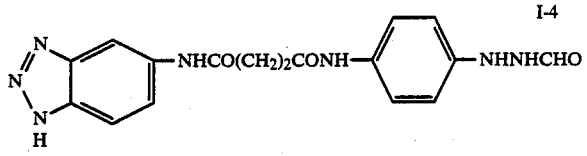
I-5
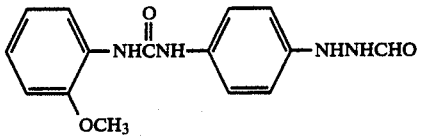
I-6
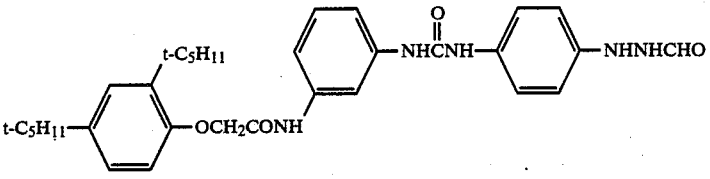
I-7
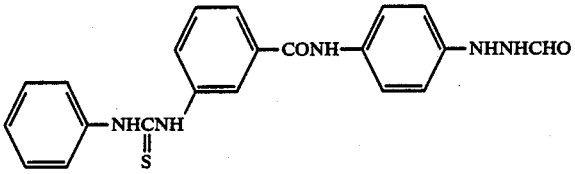
I-8
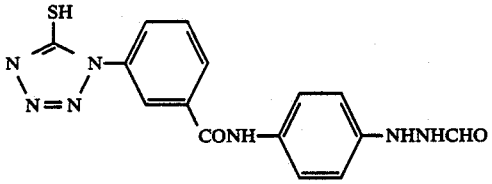
I-9
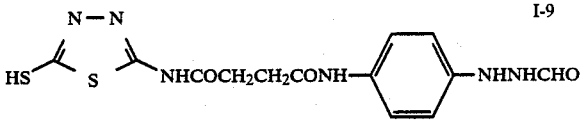
I-10
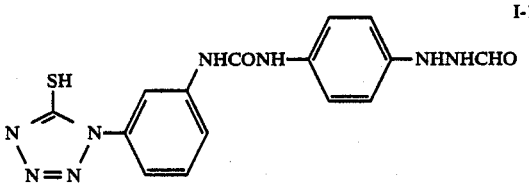
I-11
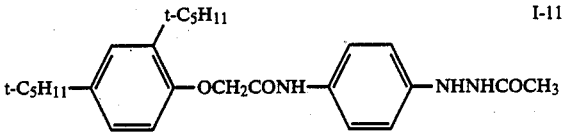
I-12
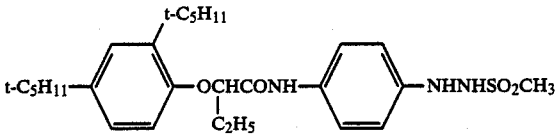
I-13
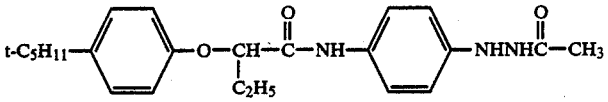
I-14
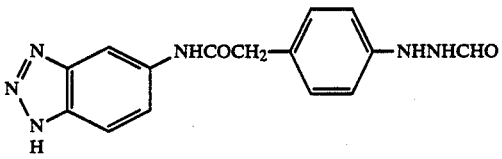

-continued

I-15

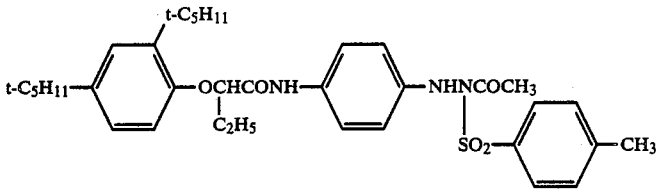

I-16

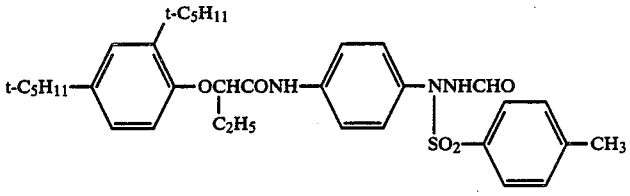

I-17

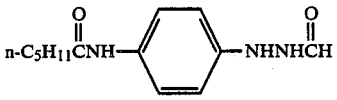

I-18

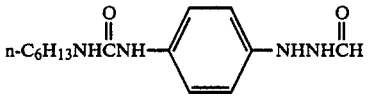

I-19

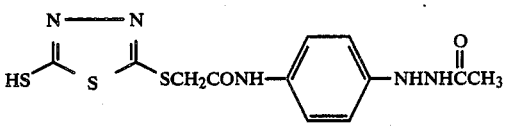

I-20

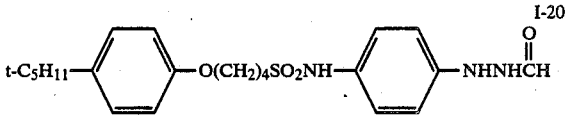

I-21

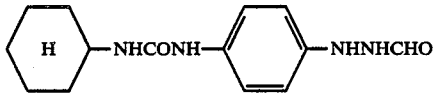

In the case of incorporating the hydrazine derivative in the photographic light-sensitive material of this invention, it is preferred that the hydrazine derivative is incorporated in the silver halide emulsion layer thereof but it may be incorporated in other light-insensitive hydrophilic colloid layer (e.g., a protective layer, an interlayer, a filter layer, an antihalation layer, etc.,).

Practically, the hydrazine derivative may be added to a hydrophilic colloid solution as an aqueous solution when the compound is water-soluble or as a solution of an organic solvent miscible with water, such as an alcohol, an ester, a ketone, etc., when the compound is slightly water-soluble. In the case of incorporating the compound in the silver halide emulsion layer, the compound may be added to the silver halide emulsion at any time from the initiation of chemical ripening to coating the emulsion but it is preferred that the compound is added at a time after the completion of chemical ripening before coating. It is particularly preferred that the compound is added to the finished coating composition for the silver halide emulsion layer.

It is preferred that the content of the hydrazine derivative is suitably selected according to the grain size and the halogen composition of the silver halide emulsion, the method and extent of chemical sensitization for the silver halide emulsion, the relation, in the case of incorporating the compound in a hydrophilic colloid layer, between the hydrophilic colloid layer and a silver halide emulsion layer, the kinds of an antifoggants, etc. The test method for the selection of the compound is well known for a person skilled in the art. Ordinary, it is preferred to use the hydrazine derivative in the range of $1\times10^{-6}$ to $1\times10^{-1}$ mole, particularly $1\times10^{-5}$ to $4\times10^{-2}$ mole per mole of the silver halide in the silver halide emulsion layer.

Also, the hydrazine derivative may be added to a developer which is used for the silver halide photographic light-sensitive materials of this invention. In this case, the amount thereof is preferably 5 mg to 5 g, particularly 10 mg to 1 g per liter of the developer.

Then, the cationic dye for use in this invention is described in detail.

The cyanine dye for use in this invention as the cationic dye is represented by following general formula (II)

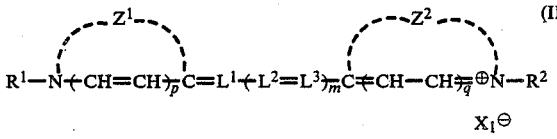

(II)

wherein, $Z^1$ and $Z^2$, which may be the same or different, each represents an atomic group necessary for forming 5- to 6-membered heterocyclic ring; $R^1$ and $R^2$, which may be the same or different, each represents an alkyo group or a substituted alkyl group; $L^1$, $L^2$ and $L^3$ each represents a methine group or a substituted methine group; p and q each represents 0 or 1; m represents 0, 1, 2, or 3; and $X_1^{\ominus}$ represents an anion.

Also, the hemicyanine dye for use in this invention as the cationic cye is represented by following general formula (III)

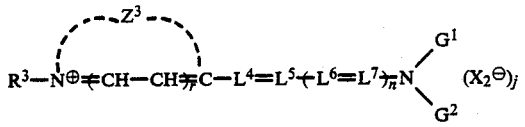

(III)

wherein, $Z^3$ is the same as defined for $Z^1$ and $Z^2$; $R^3$ is the same as defined for $R^1$ and $R^2$; $L^4$, $L^5$, $L^6$ and $L^7$ are the same as defined for $L^1$, $L^2$ and $L^3$; r is the same as defined for p and q; $X_2\ominus$ is the same as defined $X_1\ominus$; j represents 1 or 2; n represents 0, 1 or 2; and $G^1$ and $G^2$, which may be the same or different, each represents a hydrogen atom, an alkyl group, a substituted alkyl group, an aryl group or a substituted aryl group; said $G^1$ and $G^2$ may form a ring induced from a cyclic secondary amine.

The rhodacyanine dye for use in thie invention as the cationic dye is represented by following general formula (IV)

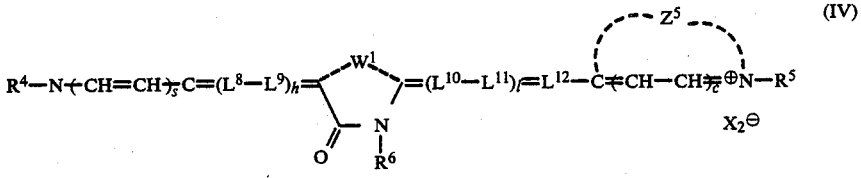

(IV)

wherein, $Z^4$ and $Z^5$ are the same as defined for $Z^1$ and $Z^2$; $R^4$ and $R^5$ are the same as defined for $R^1$ and $R^2$; $R^6$ represents a hydrogen atom, an alkyl group, a substituted alkyl group, an aryl group, a substituted aryl group, or a heterocyclic group; $L^8$, $L^9$, $L^{10}$, $L^{11}$, and $L^{12}$ are the same as defined for $L^1$, $L^2$, and $L^3$; $W^1$ represents an atomic group necessary for forming a 5- or 6-membered heterocyclic ring; h and l are the same as defined for m; s and t are the same as defined for p and q; and $X_2\ominus$ is the same as defined for $X_1\ominus$.

Examples of the 5- or 6-membered heterocyclic ring formed by $Z^1$, $Z^2$, $Z^3$, $Z^4$ and $Z^5$ include a thiazole nucleus (e.g., thiazole, 4-methylthiazole, 4-phenylthiazole, 4,5-dimethylthiazole, 4,5-diphenylthiazole, etc.,), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-benzylbenzothiazole, 5,6-methylbenzothiazole, 5-hydroxy-6-methylbenzothiazole, tetrahydrobenzothiazole, 4-phenylbenzothiazole, etc.,), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.,), a thiazoline nucleus (e.g., thiazoline, 4-methylthiazoline, 4-nitrothiazoline, etc.,), an oxazole nucleus (e.g., oxazole, 4-methyloxazole, 4-nitrooxazole, 5-methyloxazole, 4-phenyloxazole, 4,5-diphenyloxazole, 4-ethyloxazole, etc.,), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.,), a naphthoxazole nucleus (e.g., naphtho[2,1-d]oxazole, naphtho[1,2-d]oxazole, naphtho[2,3-d]oxazole, 5-nitronaphtho[2,1-d]oxazole, etc.,), an isoxazole nucleus (e.g., 5-methylisoxazole, benzoisoxazole, etc.,), an oxazoline nucleus (e.g., 4,4-dimethyloxazoline, etc.,), a selenazole nucleus (e.g., 4-methylselenazole, 4-nitroselenazole, 4-phenylselenazole, etc.,), a benzoselenazole nucleus (e.g., benzoselenazole, 6-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, etc.,), a naphthoselenazole nucelus (e.g., naphtho[2,1-d]selenazole, naphtho[1,2-d]selenazole, etc.,), a terazole nucleus (e.g., benzoterazole, 5-methylbenzoterazole, 5,6-dimethylterazole, 5-methoxybenzoterazole, 5-hydroxybenzoterazole, 5-methylthiobenzoterazole, 5,6-dimethoxybenzoterazole, naphtho[1,2-d]terazole, 8-methylnaphtho[1,2-d]terazole, 6-methoxynaphtho[1,2-d]terazole, etc.,), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine, etc.,), an imidazole nucleus (e.g., 1-alkylimidazole, 1-alkyl-4-phenylimidazole, 1-alkylbenzoylimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphtho[1,2-d]imidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, 1-arylnaphtho[1,2-d]imidazole, etc., said alkyl group is preferably an unsubstituted alkyl group having 1 to 8 carbon atoms (e.g., methyl, ethyl, propyl, isopropyl, butyl, etc.,) or a hydroxyalkyl group (e.g., 2-hydroxyethyl, 3-hydroxypropyl, etc.,), or particularly preferably a methyl group or an ethyl group and said aryl group is a phenyl group, a halogen (e.g., chlorine)-substituted phenyl group, an alkyl (e.g., methyl)-substituted phenyl group, an alkoxy (e.g., methoxy)-substituted phenyl group, etc.,), a pyridine nucleus (e.g., 2-pyridine, 4-pyridine, 5-methyl-2-pyridine, 3-methyl-4-pyridine, etc.,), a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro- 1-isoquinoline, 3,4-dihydro-1-isoquinoline, 6-nitro-3-isoquinoline, etc.,), an imidazo[4,5-b]quinoxaline nucleus [e.g., 1,3-diethylimidazo[4,5-b]quinoxaline, 6-chloro-1,3-diallylimidazo[4,5-b]quinoxaline, etc.,), an oxadiazole nucleus, a thiadiazole nucleus, a tetrazole nucleus, a pyrimidine nucleus, etc.

$W^1$ represents an atomic group necessary for forming a 5- or 6-membered nitrogen-containing heterocyclic ring, and preferred examples of $W^1$ include

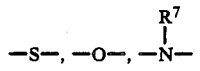

(wherein $R^7$ is the same as $R^6$.),

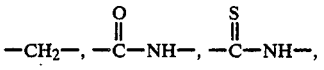

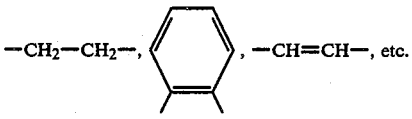

Also, $L^1$, $L^2$, $L^3$, $L^4$, $L^5$, $L^6$, $L^7$, $L^8$, $L^9$, $L^{10}$, $L^{11}$, and $L^{12}$ represent a methine group or a substituted methine group as described above and examples of the substituent include an alkyl group (e.g., a methyl group, an ethyl group, etc.,), an aryl group (e.g., a phenyl group, etc.,), an aralkyl group (e.g., a benzyl group, etc.,), a halogen atom (e.g., chlorine, bromine, etc.,), an alkoxy group (e.g., a methoxy group, an ethoxy group, etc.,), etc. Also, the substituents fro the methine chain may form a 4- to 6-membered ring with each other.

Examples of the alkyl group, which may be substituted, represented by $R^1$, $R^2$, $R^3$, $R^4$, or $R^5$ include an alkyl group having 1 to 18 carbon atoms, preferably 1 to 7 carbon atoms, more preferably 1 to 4 carbon atoms such as an unsubstituted alkyl group (e.g., a methyl group, an ethyl group, a propyl group, an isopropyl group, a butyl group, an isobutyl group, a hexyl group, an actyl group, a dodecyl group, an octadecyl group, etc.,) and a substituted alkyl group [e.g., an aralkyl group (e.g., a benzyl group, a 2-phenylethyl group, etc.,), a hydroxyalkyl group (e.g., a 2-hydroxyethyl group, a 3-hydroxypropyl group, etc.,), an alkoxyalkyl group (e.g., a 2-methoxyethyl group, a 2-methoxyethoxyethyl group, etc.,), and a heterocyclic ring-substituted alkyl group (e.g., a 2-(pyrolidin-2-one-1-yl)ethyl group, a tetrahydroflufuryl group, etc.,), a 2-acetoxyethyl group, a carbomethoxymethyl group, a 2-methanesulfonylaminoethyl group, an allyl group, etc.,].

Also, examples of the alkyl group, the substituted alkyl group, the aryl group, the substituted aryl group and the heterocyclic group shown by $R^6$ in general formula (IV) shown above include an alkyl group having 1 to 18 carbon atoms, preferably 1 to 7 carbon atoms, more preferably 1 to 4 carbon atoms (e.g., a methyl group, an ethyl group, a propyl group, an isopropyl group, a butyl group, an isobutyl group, a hexyl group, an octyl group, a dodecyl group, an octadecyl group, etc.,), a substituted alkyl group [e.g., an aralkyl group (e.g., a benzyl group, a 2-phenylethyl group, etc.,), a hydroxyalkyl group (e.g., a 2-hydroxyethyl group, a 3-hydroxypropyl group, etc.,), an alkoxyalkyl group (e.g., a 2-methoxyethyl group, a 2-(2-methoxyethoxy)ethyl group, etc.,), a heterocyclic ring-substituted alkyl group (e.g., a 2-(pyrolidin-2-one-1-yl)ethyl group, a tetrahydroflufuryl group, a 2-morpholinoethyl group, etc.,), a 2-acetoxyethyl group, a carbomethoxymethyl group, a 2-methanesulfonylaminoethyl group, an allyl group, etc.,], an aryl group (e.g., a phenyl group, a 2-naphthyl group, etc.,), a substituted aryl group (e.g., a 4-carboxyphenyl group, a 4-sulfophenyl group, a 3-chlorophenyl group, a 3-methylphenyl group, etc.,), a heterocyclic group (e.g., a 2-pyridyl group, a 2-thiazolyl group, etc.,), etc.

Also, p, q, r, s, and t represent 0 or 1; m, l, and h represent 0, 1, 2, or 3; j represents 1 or 2; and n represents 0, 1, or 2.

Then, specific examples of the cationic dyes for use in this invention are illustrated below but the scope of this invention is not limited to these compounds.

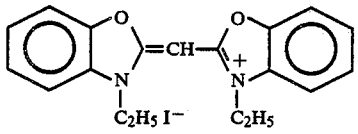

1.

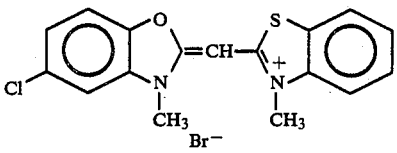

2.

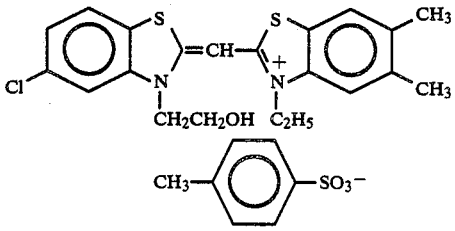

3.

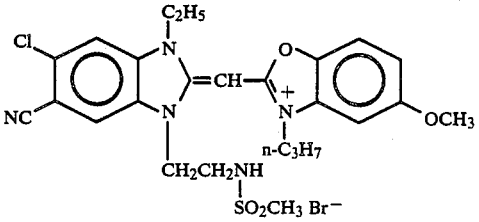

4.

-continued
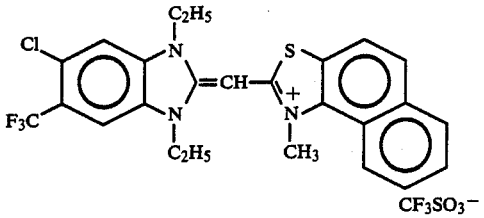
5.
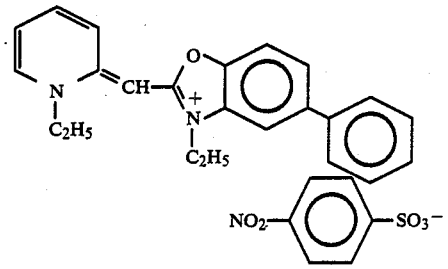
6.
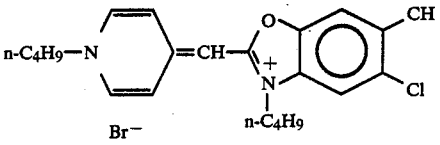
7.
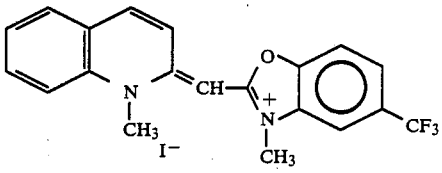
8.
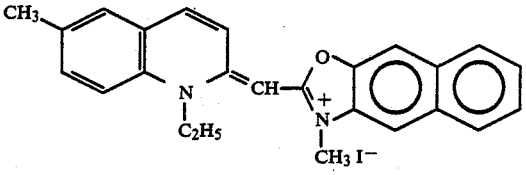
9.
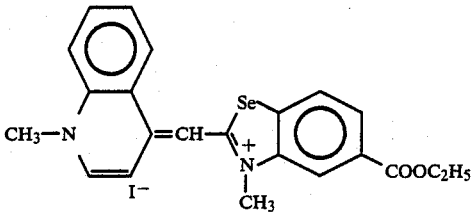
10.
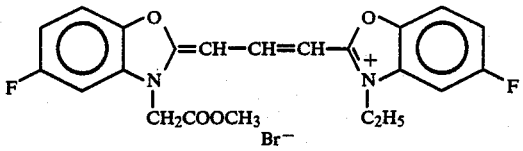
11.
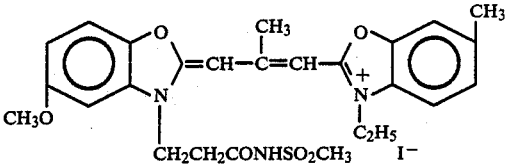
12.
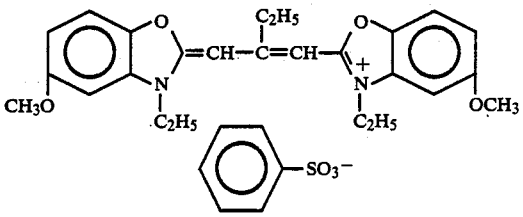
13.
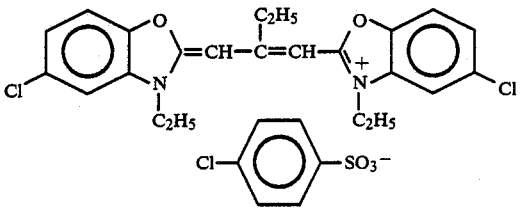
14.
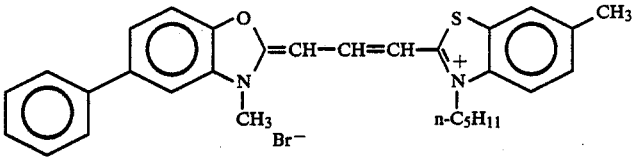
15.
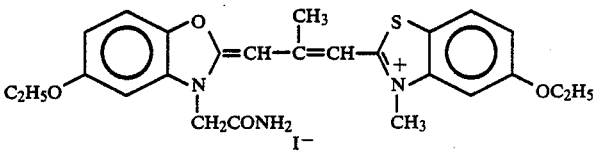
16.

-continued
17.
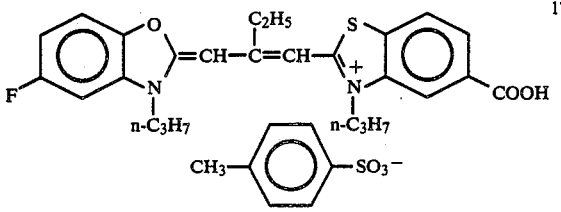
18.
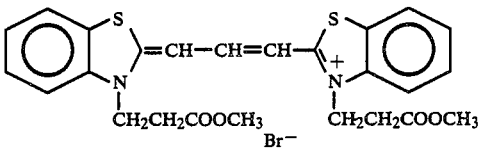
19.
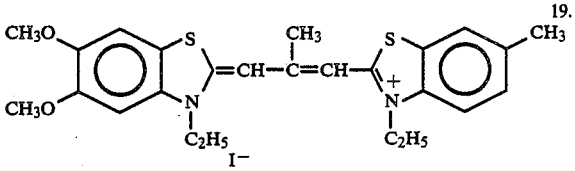
20.
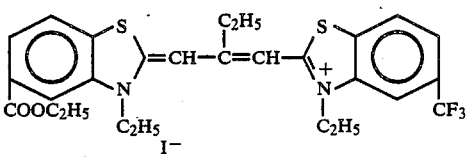
21.
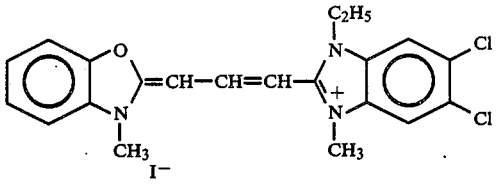
22.
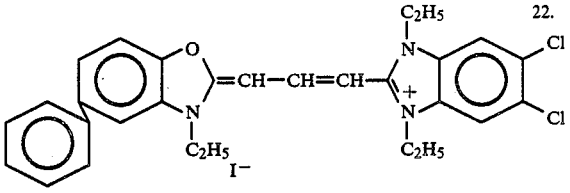
23.
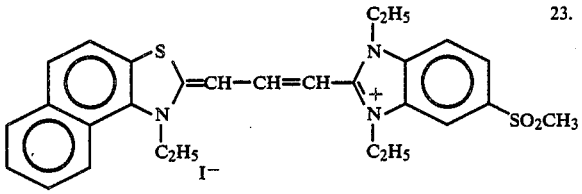
24.
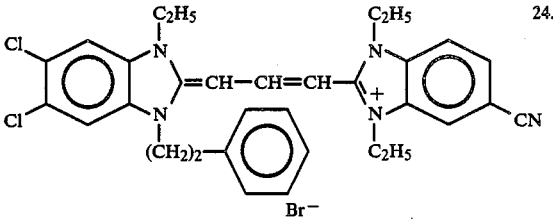
25.
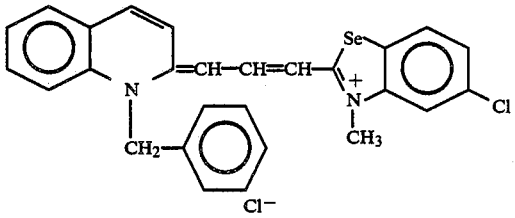
26.
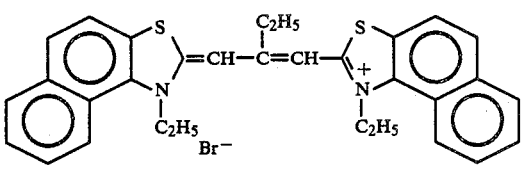
27.
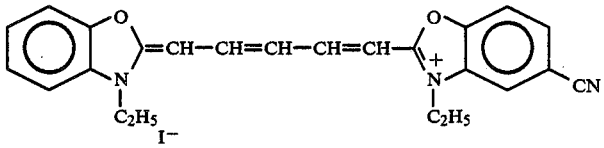
28.
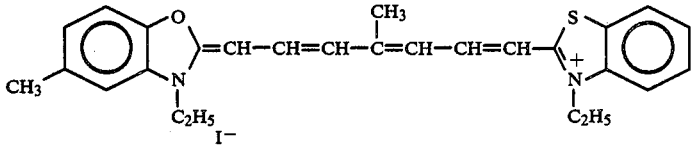
29.
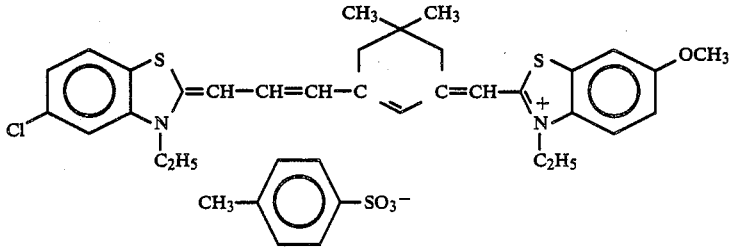

-continued
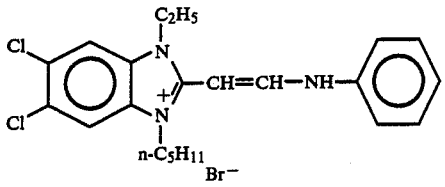
30.
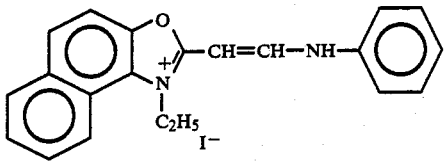
31.
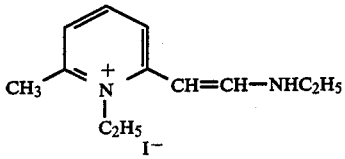
32.
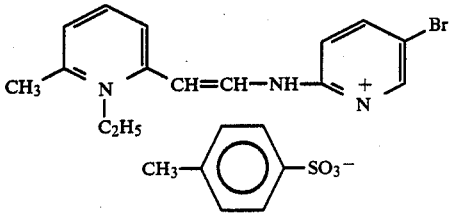
33.
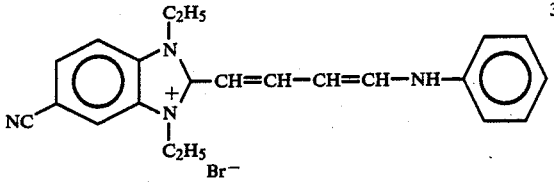
34.
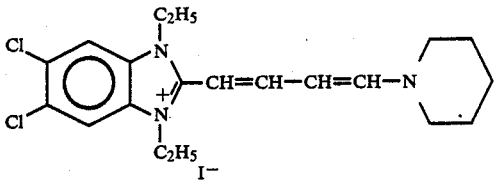
35.
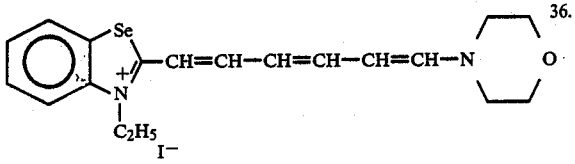
36.
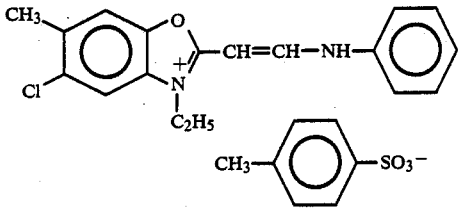
37.
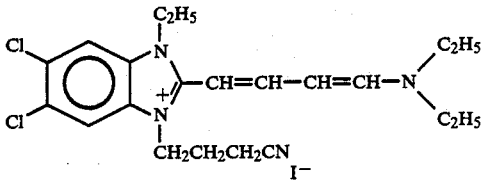
38.
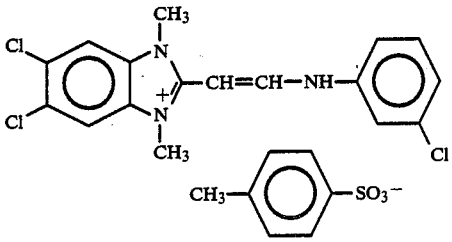
39.
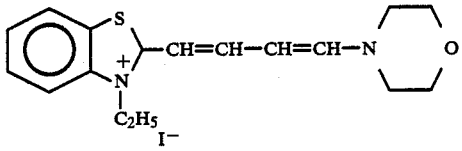
40.
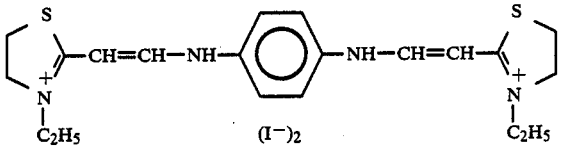
41.
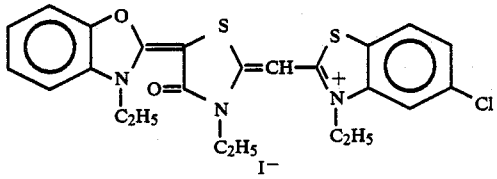
42.
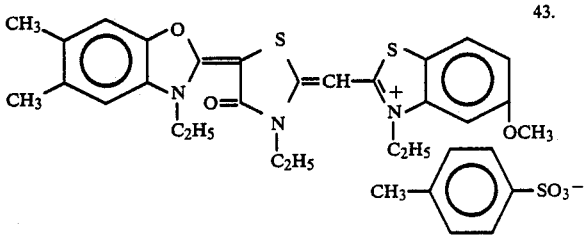
43.

-continued

44.

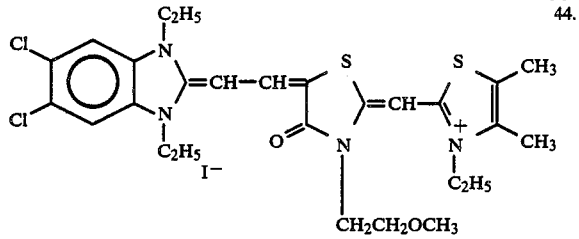

45.

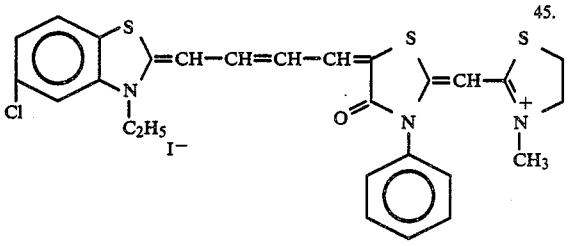

46.

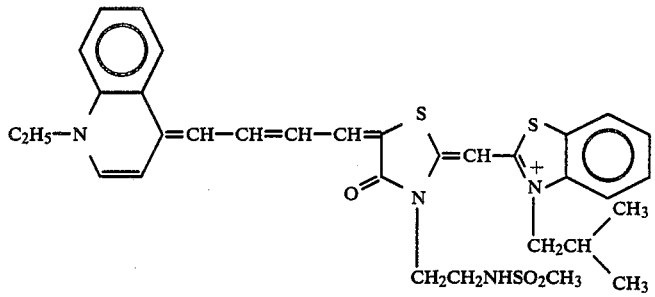

47.

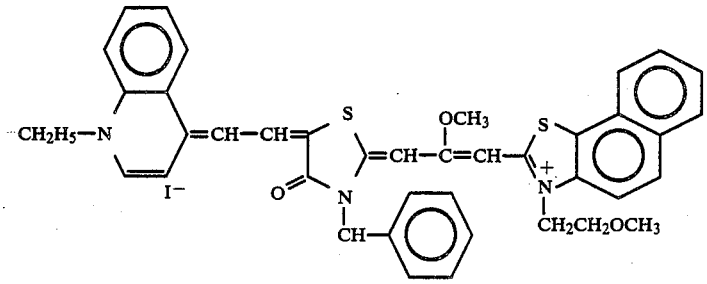

48.

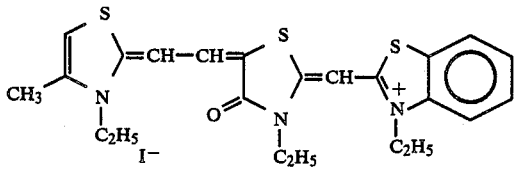

49.

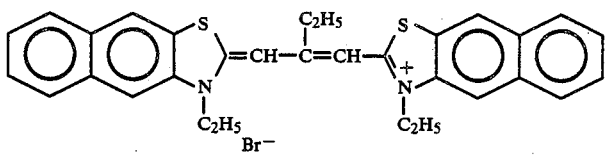

The above-described compounds may be used solely or as a combination thereof. There is no particular restriction about the amount of the cationic dye but the amount is preferably $1\times10^{-7}$ to $1\times10^{-2}$ mole, more preferably $1\times10^{-6}$ to $1\times10^{-3}$ mole per 1 moles of the silver halide in the silver halide emulsion layer.

L-Ascorbic acid which is used in this invention together with the above-described components may be used not only for the silver halide emulsion layer(s) but also for other hydrophilic colloid layer such as a subbing layer, a protective layer, etc. The addition amount of L-ascorbic acid is 1 mg to 500 mg/m$^2$, preferably 10 mg to 200 mg/m$^2$, more preferably 20 mg to 100 mg/m$^2$.

The silver halide for the silver halide emulsion(s) for use in this invention may be silver cloride, silver chlorobromide, silver iodobromide, silver iodochloro-bromide, etc., but a silver halide containing more than 70 mole%, particularly more than 90 mole% silver bromide is prefered. In this case, it is preferred that the content of silver iodide in the silver haldie is less than 10 mole%, particularly 0.1 to 5 mole%.

It is preferred that the mean grain size of the silver halide for use in this invention is fine (e.g., less than 0.7 μm), particularly less than 0.5 μm. Also, there is no particular restriction about the grain size distribution of the silver halide emulsion for use in this invention but a mono-dispersed type silver halide emulsion is preferred. The term "mono-dispersed emulsion" used herein means that a silver halide emulsion composed of silver halide grains at least 95% of which as weight or grain number is within ±40% of the mean grain size.

The silver halide grains in the silver halide photographic emulsion for use in this invention may have a regular crystal form such as a cube or an octahedron, or an irregular crystal form such as a sphere, a tabular form, etc., or may have a composite form of these crystal forms.

The silver halide grains for use in this invention may have a homogeneous phase throughout the whole grains or may have different phase between the inside thereof and the surface layer thereof. Two or more kinds of silver halide emulsions separately prepared may be used as a mixture of them.

The silver halide emulsion for use in this invention may be formed or physically ripened in the presence of a cadmium salt, a sulfite, a lead salt, a thallium salt, a rhodium salt or a complex salt thereof, an iridium salt or a complex salt thereof, etc.

The silver halide particularly suitable for use in this invention is a silver haloiodide which is prepared in the existence of an iridium salt or a complex salt in an amount of $10^{-8}$ to $10^{-5}$ per mole of silver and the silver iodide content of the grain surface of which is larger than the silver iodide content of the mean value of the whole grains. By using such a silver haloiodide, photographic characteristics having higher sensitivity and gamma are obtained.

In the case of preparing the aforesaid silver halide, it is preferred to add an iridium salt of the aforesaid amount before finishing physical ripening of the silver halide emulsion in the production step thereof, in particular at the formation of silver halide grains.

As the iridium salt for use in this invention, there are water-soluble iridium salts or iridium complex salts such as iridium trichloride, iridium tetrachloride, potassium hexachloroiridate(III), potassium hexachloroiridate(IV), ammonium hexachloroiridate(III), etc.

As the binder of the silver halide emulsion or as a protective colloid, gelatin is advantageously used but other hydrophilic colloids can be used. For example, there are proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; sugar derivatives such as sodium alginate, starch derivatives, etc.; and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

The silver halide emulsion for use in this invention may be or may not be chemically sensitized. As a chemical sensitizing method, there are a sulfur sensitization, a reduction sensitization, and a noble metal sensitization and they can be used individually or as a combination thereof.

A typical noble metal sensitizing method is a gold sensitizing method and a gold compound, in particular a gold complex salt is mainly used. Complex salts of other noble metals than gold, such as platinum, palladium, rhodium, etc., may be used. Practical examples of these noble metal compounds are described in U.S. Pat. No. 2,448,060 and British Pat. No. 618,061.

Also, as a sulfur sensitizer, sulfur compounds contained in gelatin, various sulfur compounds such as thiosulfates, thioureas, thiazoles, rhodanines, etc., can be used.

As a reduction sensitizer, stannous salts, amines, formamidinesulfinic acid, silane compounds, etc., can be used.

For the photographic light-sensitive materials of this invention, the compounds described in Japanese Patent Application Nos. 248,913/83 and 9347/85 can be used for increasing the sensitivity and contrast thereof. These compounds may be used solely or as a combination thereof.

In this invention, the cationic dye described above may be used together with at least one of an anionic dye, a betaine dye, and a non-charging dye.

As the dyes which can be used together with the cationic dyes in this invention, there are the sensitizing dyes (e.g., cyanine dyes, merocyanine dyes, etc.,) described in Japanese Patent Application (OPI) No. 52,050/80, pages 45–53. The term "OPI" as used herein refers to a "published unexamined Japanese patent application".

The photographic light-sensitive material of this invention may contain various compounds for preventing the occurrence of fog during the production, storage and photographic processing of the light-sensitive material or stabilizing the photographic performance thereof. For example, there are azoles such as a benzothiazolium salt, nitroindazoles, chlorobenzimidazoles, bromobenzimidazoles, mercaptothiazoles, mercaptobenzothiazoles, mercaptodiazoles, aminotriazoles, benzothiazoles, nitrobenzotriazoles, etc.; mercaptopyrimidines; mercaptotriazines; thioketo compounds such as oxazolinethione, etc.; azaindenes, such as triazaindenes, tetraazaindenes (in particular, 4-hydroxy-substituted (1,3,3a,7)tetrazaindenes, etc.,), pentaazaindenes, etc.; benzenesulfonic acid, benzenesulfinic acid, benzenesulfonic acid amide, etc., which are known as antifoggants or stabilizers. In these compounds, benzotriazoles (e.g., 5-methylbenzotriazole, etc.,) and nitroindazoles (e.g., 5-nitroindazole, etc.,) are preferred. These compounds may exist in developers.

The photographic light-sensitive material of this invention may contain an inorganic or organic hardening agent in a silver halide photographic emulsion or other hydrophilic colloid layer. For example, there are chromium salts (chromium alum, chromium acetate, etc.,), aldehydes (e.g., formaldehyde, glyoxale, glutar aldehyde, etc.,), N-methylol compounds (e.g., dimethylolurea, methyloldimethylhydantoin, etc.,), dioxane derivatives (2,3-dihydroxydioxane, etc.,), active vinyl compounds (e.g., 1,3,5-triacryloylhexahydro-s-triazine, 1,3-vinylsulfonyl-2-propanol, etc.,), active halogen compounds (e.g., 2,4-dichloro-6-hydroxy-2-triazine, etc.,), mucohalogenic acids (mucochloric acid, mucophenoxychloric acid, etc.,), etc. They can be used solely or as a combination thereof.

Also, the photographic light-sensitive material of this invention may contain various surface active agents in the photographic emulsion layer or other hydrophilic colloid layer(s) as coating aid and various purposes of static prevention, the improvement of sliding property, the improvement of dispersibility, the prevention of sticking, the improvement of photographic properties (e.g., a development acceleration, the increase of contrast, the improvement of sensitivity, etc.,).

Examples of these surface active agents include nonionic surface active agents such as saponin (steroid series), alkyleneoxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide adducts of silicone, etc.,), glicidol derivatives (e.g., alkenylsuccinic acid polyglyceride, alkylphenol polyglyceride, etc.), fatty acid esters of polyhydric alcohols, alkyl esters of sugar, etc.; anionic surface active agents containing acid groups (e.g., a carboxy group, a sulfo group, a phospho group, a sulfuric acid ester group, a phosphoric acid ester group, etc.,), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphopshoric acid esters, etc.; amphoteric surface active agents such as amino acids, aminoalkylsulfonic acids, aminoalkylsulfuric acid esters, aminoalkylphopshoric acid esters, alkylbetaines, amineoxides, etc.; and cationic surface active agents such as alkylamine salts, aliphatic or aromatic quaternary ammonium salts, heterocyclic quaternary ammonium salts (e.g., pyridinium, imidazolium, etc.,), phosphonium or sulfonium salts containing an aliphatic or heterocyclic ring, etc.

The particularly preferred surface active agents for use in this invention are the polyalkylene oxides having 600 or more molecular weights described in Japanese Patent Publication No. 9412/83.

The photographic light-sensitive material of this invention may contain a matting agent such as silica, magnesium oxide, polymethyl methacrylate, etc., in the silver halide photographic emulsion layer or other hydrophilic colloid layer.

Furthermore, the photographic light-sensitive material of this invention can contain a dispersion of a water-soluble or slighyly water-soluble synthetic polymer for improving dimensional stability, etc. Examples of the synthetic polymer include polymers of an alkyl (meth)acrylate, an alkoxyalkyl (meth)acrylate, glycidyl (meth-)acrylate, (meth)acrylamide, a vinyl ester (e.g., vinyl acetate, etc.,), acrylonitrile, olefin, styrene, etc., solely or as a combination of them, or further as a combination of the aforesaid monomer(s) and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

As the support for the light-sensitive material of this invention, cellulose triacetate, cellulose diacetate, nitrocellulose, polystyrene, polyethylene terephthalate, etc., can be used and in these materials, polyethylene terephthalate is most preferred.

For obtaining photographic characteristics of high contrast and high sensitivity using the silver halide light-sensitive materials of this invention, a stable developer can be used without need of using a conventional infectious developer in the high-alkaline developer of about pH 13 described in U.S. Pat. No. 2,419,975.

That is, the silver halide photographic light-sensitive materials of this invention can provide negative images of sufficiently high contrast using a developer containing at least 0.15 mole/liter of a sulfite ion as a preservative and having a pH of 10.5 to 12.3, particularly 11.0 to 12.3.

There is no particular restriction on the developing agent for use in the process of this invention. For example, dihydroxybenzenes (e.g., hydroquinone, etc.,), 3-pyrazolidones (e.g., 1-phenyl-3-pyrazolidone, 4,4-dimethyl-1-phenyl-3-pyrazolidone, etc.,), aminophenols (e.g., N-methyl-p-aminophenol, etc.,), etc., can be used solely or as a combination thereof.

The silver halide light-sensitive material of this invention is particularly suitable for processing with a developer containing a dihydroxybenzene as a main developing agent and a 3-pyrazolidone or an aminophenol as an auxiliary developing agent. It is preferred that the developer contains 0.05 to 0.5 mole/liter of dihydroxybenzene and at most 0.06 mole/liter of a 3-pyrazolidone or an aminophenol.

By adding an amine to the developer, the developing speed can be increased and the reduction of developing time can be realized as described in U.S. Pat. No. 4,269,929.

Furthermore, the developer may contain a pH buffer such as a sulfite, a carbonate, a borate, or a phosphate of an alkali metal or a development restrainer or an antifoggant such as a bromide, an iodide, and an organic antifoggant (particularly preferably a nitroindazole and a benzotriazole). Also, the developer may, if necessary, contain a water softener, a dissolution aid, a toning agent, a development accelerator, a surface active agent (particularly preferably the aforesaid polyalkylene oxides), a defoaming agent, a hardening agent, a silver stain preventing agent for photographic film (e.g., 2-mercaptobenzimidazolesulfonic acids, etc.,), etc.

A fix solution having an ordinary composition can be used in the process of this invention. That is, as a fixing agent, there are thiosulfates, thiocyanates, and orgranic sulfur compounds which are known to have an effect as fixing agent. Furthermore, the fix solution may contain a water-soluble aluminum salt as a hardening agent.

The processing temperature in the process of this invention is usually selected in the range of 18° C. to 50° C.

It is preferred to use an automatic processor for the photographic process of this invention. In the process of this invention, negative tone photographic characteristics having sufficiently high contrast can be obtained even when the total processing time in an automatic processor for processing the photographic light-sensitive material of this invention is established between 90 seconds to 120 seconds.

Then, the invention is further explained below in detail by the following examples.

In addition, in the following examples the developers having the following compositions were used.

Fundamental Composition of Developer:

Hydroquinone: 35.0 g
N-Methyl-p-aminophenol ½ Sulfate: 0.8 g
Sodium Hydroxide: 13.0 g
Potassium Tertially Phosphate: 74.0 g
Potassium Sulfite: 90.0 g
Ethylenediaminetetraacetic Acid Tetrasodium Salt: 1.0 g
Potassium Bromide: 4.0 g
5-Methylbenzotriazole: 0.6 g
3-Diethylamino-1,2-propanediol: 15.0 g
Water to make: 1 liter
(pH=11.5)

In this case, the developer having pH of 11.5 is defined as Developer (I) and the developer having pH of 11.6 is defined as Developer (II).

EXAMPLE 1

To an aqueous gelatin solution kept at 50° C. were simultaneously added an aqueous solution of silver nitrate and an aqueous solution of potassium iodide and potassium bromide in the existence of hexachloroiridium(III) potassium in an amount of $4\times10^{-7}$ mole per mole of silver and ammonia over a period of 60 minutes while maintaining pAg of the system at 7.8 to provide a cubic mono-dispersed silver halide emulsion having a mean grain size of 0.25 μm and a mean silver iodide content of 1 mole%.

Then, after adding to the silver iodide emulsion the compound shown in Table 1 below as a sensitizing dye and furthermore a dispersion of 4-hydroxy-6-methyl-1,3,3a,7-tetraazaindene and polyethyl acrylate, polyethylene glycol, 1,3-vinylsulfonyl-2-propanol, 1-phenyl-5-mercaptotetrazole, 1,4-bis[3-(4-acetylaminopyridinio)-propionyloxy]tetramethylene dibromide, and Compound I-3 shown above and L-ascorbic acid in the amounts shown in Table 1 below as stabilizers, the resultant mixture was coated on a polyethylene terephthalate film at a silver coverage of 3.4 g/m$^2$. At the same time, a gelatin solution was coated on the silver halide emulsion layer at a gelatin coverage of 1.0 g/m$^2$.

Each sample thus prepared was image-exposed and developed by the developer described above and then the photographic properties thereof was measured. The results thus obtained are shown in Table 1 below. The measurements for the values shown in the table were performed by the manner as shown below.

Relative Sensitivity:

The relative value of the reciprocal of the exposure amount giving a density of 1.5 in the development at 38° C. for 30 sec., the value of Sample 1 being taken as 100.

Black Pepper:

The occurrence of black pepper is evaluated in five grades by microscopic observation, wherein grade "5" shows the best quality and grade "1+ the worst quality. Grades "5" and "4" are practically usable, Grade "3" is not so good but is barely usable, but Grades "1" and "2" are unsuitable for practical use. The grade between "1" and "2" is shown as "1.5".

The evaluation of the black pepper is the results of developing the sample at 38° C. for 40 sec. using Developer II.

Evaluation of Practical Dmax:

The fine holizontal line was printed by using a manual photocomposer paper PL-100WP (trade name, made by Fuji Photo Film CO., Ltd.) and was scanned in the direction perpendicular to the line by means of a microdensitometer, whereby it was confirmed that the line width (black portion) at an optical density of 0.8 of reflected light was 40 μm.

The character was photographed as an original using each sample described above by means of a reflection type printing plate making camera DSC-351 (trade name, made by Dainippon Screen Mfg. Co., Ltd.), the sample was then developed, fixed and washed as described above, and then the image of the negative film thus obtained was scanned on the portion corresponding to the aforesaid line portion by microdensitometer. In this case, the sample giving such an exposure that the line width (cleaned line portion) at the optical density of 0.8 of transmitted light is called as line to line reproducibility condition.

The value obtained by measuring the optical density of transmitted light of the portion (solid black portion) on the nega film corresponding to the background portion of the oliginal in the case of the line to line reproducibility condition by means of a Macbeth desitometer TD-504 was evaluated as practical Dmax.

In general, the practical Dmax of 3.5 is the practically usable limit and it is preferred that the value is higher than 4.0.

TABLE 1

| Sample No. | Amount of Compound I-3 (mol/Ag mol) | Sensitizing Dye | | Additive | | Photographic Property | | | | Remark |
|---|---|---|---|---|---|---|---|---|---|---|
| | | Compound | Amount (mol/Ag mol) | Compound | Amount (mg/m$^2$) | Sensitivity | Y | Dmax | Black Pepper | |
| 1 | $4.8 \times 10^{-3}$ | Compound 26 | $5.6 \times 10^{-5}$ | — | — | 100 | 14 | 3.8 | 1 | Comparison |
| 2 | " | " | " | L-Ascorbic Acid | 5 | 100 | 14.5 | 4.1 | 3 | Invention |
| 3 | " | " | " | L-Ascorbic Acid | 20 | 103 | 15 | 4.2 | 4 | " |
| 4 | " | " | " | L-Ascorbic Acid | 50 | 107 | 15 | 4.3 | 4 | " |
| 5 | " | " | " | L-Ascorbic Acid | 100 | 103 | 16 | 4.3 | 4.5 | " |
| 6 | " | " | " | L-Ascorbic Acid | 200 | 103 | 15 | 4.2 | 4.5 | " |
| 7 | $6.0 \times 10^{-3}$ | " | " | L-Ascorbic Acid | 50 | 120 | 17 | 4.5 | 5 | " |
| 8 | $4.8 \times 10^{-3}$ | Comparative Compound A | " | — | — | 65 | 8 | 2.8 | 5 | Comparison |
| 9 | " | Comparative Compound A | " | L-Ascorbic Acid | 20 | 60 | 7.6 | 2.8 | 5 | " |
| 10 | " | Comparative Compound A | " | L-Ascorbic Acid | 50 | 51 | 6.3 | 2.7 | 5 | " |
| 11 | $4.8 \times 10^{-3}$ | Comparative Compound A | " | L-Ascorbic Acid | 100 | 47 | 4.9 | 2.5 | 5 | " |
| 12 | " | Comparative Compound B | " | — | — | 74 | 9 | 3.1 | 5 | " |
| 13 | " | Comparative Compound B | " | L-Ascorbic Acid | 20 | 67 | 8.7 | 2.8 | 5 | " |
| 14 | " | Comparative Compound B | " | L-Ascorbic Acid | 50 | 64 | 7.8 | 2.7 | 5 | " |
| 15 | " | Comparative Compound B | " | L-Ascorbic Acid | 100 | 58 | 6.5 | 2.5 | 5 | " |

As is clear from the results shown in Table 1, Samples 2 to 7 of this invention show remarkable effect of avoiding the formation of black peppers without accompanied by the reduction in sensitivity, gamma, and practical Dmax as compared with comparison samples.

In addition, the comparative compounds A and B used in the example as sensitizing dyes are as follows.

Comparative Compound A

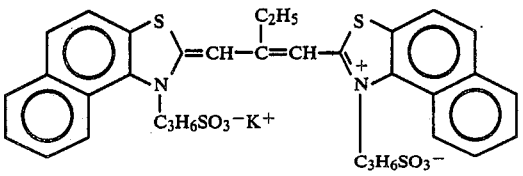

Comparative Compound B

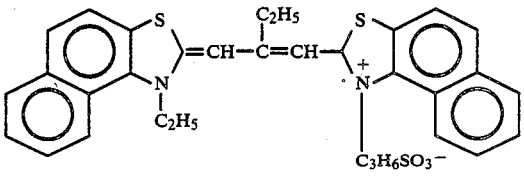

EXAMPLE 2

By following the same procedure as Example 1, the samples containing the hydrazine compounds, the sensitizing dyes, and the additive in Table 2 below were prepared.

Each of the samples thus prepared was evaluated as in Example 1 and the results are shown in Table 2 below.

TABLE 2

| Sample No. | Amount of Compound I-3 (mol/Ag mol) | Sensitizing Dye Compound | Sensitizing Dye Amount (mol/Ag mol) | Additive Compound | Additive Amount (mg/m²) | Photographic Property Sensitivity | Y | Dmax | Black Pepper | Remark |
|---|---|---|---|---|---|---|---|---|---|---|
| 16 | $2.4 \times 10^{-3}$ | Compound 26<br>Comparative Compound C | $5.6 \times 10^{-5}$<br>$3.4 \times 10^{-4}$ | — | — | 100 | 16 | 4.1 | 1 | Comparison |
| 17 | " | Compound 26<br>Comparative Compound C | $5.6 \times 10^{-5}$<br>$3.4 \times 10^{-4}$ | L-Ascorbic Acid | 5 | 103 | 16.5 | 4.2 | 3 | Invention |
| 18 | " | Compound 26<br>Comparative Compound C | $5.6 \times 10^{-5}$<br>$3.4 \times 10^{-4}$ | L-Ascorbic Acid | 20 | 103 | 17 | 4.3 | 4 | " |
| 19 | " | Compound 26<br>Comparative Compound C | $5.6 \times 10^{-5}$<br>$3.4 \times 10^{-4}$ | L-Ascorbic Acid | 50 | 107 | 18 | 4.6 | 4.5 | " |
| 20 | " | Compound 26<br>Comparative Compound C | $5.6 \times 10^{-5}$<br>$3.4 \times 10^{-4}$ | L-Ascorbic Acid | 100 | 107 | 18 | 4.5 | 4.5 | " |
| 21 | " | Compound 26<br>Comparative Compound C | $5.6 \times 10^{-5}$<br>$3.4 \times 10^{-4}$ | L-Ascorbic Acid | 200 | 100 | 16 | 4.4 | 5 | " |
| 22 | $3.0 \times 10^{-3}$ | Compound 26<br>Comparative Compound C | $5.6 \times 10^{-5}$<br>$3.4 \times 10^{-4}$ | L-Ascorbic Acid | 50 | 115 | 18.5 | 4.7 | 4.5 | " |
| 23 | $2.4 \times 10^{-3}$ | Comparative Compound A<br>Comparative Compound C | $5.6 \times 10^{-5}$<br>$3.4 \times 10^{-4}$ | — | — | 61 | 8 | 3.1 | 5 | Comparison |
| 24 | " | Comparative Compound A<br>Comparative Compound C | $5.6 \times 10^{-5}$<br>$3.4 \times 10^{-4}$ | L-Ascorbic Acid | 20 | 67 | 9.5 | 3.3 | 4 | " |
| 25 | $2.4 \times 10^{-3}$ | Comparative Compound A<br>Comparative Compound C | $5.6 \times 10^{-5}$<br>$3.4 \times 10^{-4}$ | L-Ascorbic Acid | 50 | 74 | 12 | 3.5 | 3 | Comparison |
| 26 | " | Comparative Compound A<br>Comparative Compound C | $5.6 \times 10^{-5}$<br>$3.4 \times 10^{-4}$ | L-Ascorbic Acid | 100 | 74 | 12.5 | 3.6 | 3 | " |
| 27 | " | Comparative Compound B<br>Comparative Compound C | $5.6 \times 10^{-5}$<br>$3.4 \times 10^{-4}$ | — | — | 67 | 9.5 | 3.1 | 5 | " |
| 28 | " | Comparative Compound B<br>Comparative Compound C | $5.6 \times 10^{-5}$<br>$3.4 \times 10^{-4}$ | L-Ascorbic Acid | 20 | 74 | 10 | 3.3 | 3.5 | " |
| 29 | " | Comparative Compound B<br>Comparative Compound C | $5.6 \times 10^{-5}$<br>$3.4 \times 10^{-4}$ | L-Ascorbic Acid | 50 | 74 | 13 | 3.6 | 2.5 | " |
| 30 | " | Comparative Compound B<br>Comparative | $5.6 \times 10^{-5}$<br>$3.4 \times 10^{-4}$ | L-Ascorbic Acid | 100 | 74 | 14 | 3.7 | 2 | " |

TABLE 2-continued

| Sample No. | Amount of Compound I-3 (mol/Ag mol) | Sensitizing Dye Compound | Sensitizing Dye Amount (mol/Ag mol) | Additive Compound | Additive Amount (mg/m²) | Photographic Property Sensitivity | Y | Dmax | Black Pepper | Remark |
|---|---|---|---|---|---|---|---|---|---|---|
| | | Compound C | | | | | | | | |

As is clear from the results shown in Table 2, the Samples 17 to 22 of this invention show good effect for the formation of black pepper without reducing the photographic properties.

In addition, the comparative compounds A and B used in this example are same as those in Example 1 and the comparative compound C used in this example as sensitizing dyes are shown below.

Comparative Compound C

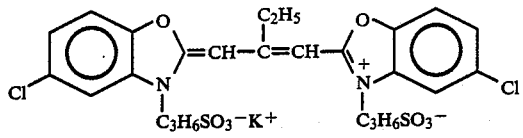

What is claimed is:

1. The sliver halide photographic light-sensitive material comprising a support having thereon at least one silver halide emulsion layer in which said silver halide emulsion layer or other hydrophilic colloid layer contains at least one hydrazine derivative, at least one cationic dye selected from a cyanine dye, a hemicyanine dye and a rhodacyanine dye, and L-ascorbic acid, wherein the hydrazine derivative is a compound represented by the general formula (I)

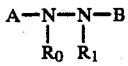

(I)

wherein, A represents an aliphatic group or an aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, or a heterocyclic group; and $R_0$ and $R_1$ both represent a hydrogen atom or one of them represents a hydrogen atom and the other represents a substituted or unsubstituted alkylsulfonyl group, a substituted or unsubstituted arylsulfonyl group, or a substituted or unsubstituted acyl group; said B, $R_1$ and the nitrogen atom to which they are bonded may form together a partial structure of hydrazone $-N=C<$.

2. The silver halide photographic light-sensitive material as claimed in claim 1, wherein the content of the hydrazine derivative is $10^{-6}$ mole to $1\times10^{-1}$ mole per mole of the silver halide in the silver halide emulsion layer.

3. The silver halide photographic light-sensitive material as claimed in claim 1, wherein the cyanine dye is a dye represented by the general formula (II)

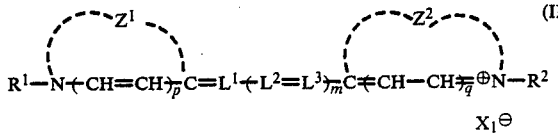

(II)

wherein, $Z^1$ and $Z^2$, which may be the same or different, each represents an atomic group necessary for forming a 5- or 6-membered heterocyclic ring; $R^1$ and $R^2$, which may be the same or different, each represents an alkyl group or a substituted alkyl group; $L^1$, $L^2$, and $L^3$ each represents a methine group or a substituted methine group; $X_1\ominus$ represents an anion; p and q each represents 0 or 1; and m represents 0, 1, 2 or 3.

4. The silver halide photographic light-sensitive material as claimed in claim 1, wherein the hemicyanine dye is a dye represented by the general formula (III)

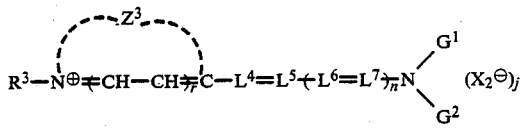

(III)

wherein $Z^3$ represents an atomic group necessary for forming a 5- or 6-membered heterocyclic ring; $R^3$ represents an alkyl group or a substituted alkyl group; $L^4$, $L^5$, $L^6$, and $L^7$ each represents a methine group or a substituted methine group; $X_2\ominus$ represents an anion; $G^1$ and $G^2$, which may be the same or different, each represents a hydrogen atom, an alkyl group, a substituted alkyl group, an aryl group, or a substituted aryl group, said $G^1$ and $G^2$ may form together a ring induced from a cyclic secondary amine; r represents 0 or 1; j represents 1 or 2; and n represents 0, 1 or 2.

5. The silver halide photographic light-sensitive material as claimed claim 1, wherein the rhodacyanine dye is a dye represented by the general formula (IV)

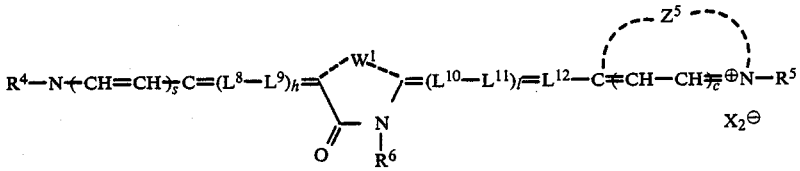

(IV)

wherein, $Z^4$ and $Z^5$, which may be the same or different, each represents a 5- or 6-membered heterocyclic ring; $R^4$ and $R^5$, which may be the same or different, each represents an alkyl group or a substituted alkyl group; $R^6$ represents a hydrogen atom, an alkyl group, a substituted alkyl group, an aryl group, a substituted aryl group, or a heterocyclic group; $L^8$, $L^9$, $L^{10}$, $L^{11}$, and $L^{12}$ each represents a methine group or a substituted methine group; $W^1$ represents an atomic group necessary for forming a 5- or 6-membered ring; $X_2^{\ominus}$ represents an anion; h and l each represents 0, 1, 2 or 3; and s and t each represents 0 or 1.

6. The silver halide photographic light-sensitive material as claimed in claim 1, wherein the content of the cationic dye is $1\times10^{-7}$ to $10^{-2}$ mole per mole of the silver halide in the silver halide emulsion layer.

7. The silver halide photographic light-sensitive material as claimed in claim 1, wherein the amount of L-ascorbic acid in the silver halide emulsion layer is 1 $mg/m^2$ to 500 $mg/m^2$.

8. A process of forming high-contrast negative images, which comprises image-exposing a silver halide photographic light-sensitive material of claim 1 comprising a support having thereon at least one silver halide emulsion layer in which said silver halide emulsion layer or other hydrophilic colloid layer contains a hydrazine derivative, at least one cationic dye selected from a cyanine dye, a hemicyanine dye and a rhodacyanine dye, and L-ascorbic acid and then developing it with a developer containing a sulfite ion of at least 0.15 mole/liter and having pH of 10.5 to 12.3.

* * * * *